US005586659A

United States Patent [19]

Trumbo

[11] Patent Number: 5,586,659

[45] Date of Patent: Dec. 24, 1996

[54] COMBINATION GIFT BOX AND GREETING CARD

[76] Inventor: Timothy F. Trumbo, Box 657, Sun Valley, Id. 83353

[21] Appl. No.: 475,456

[22] Filed: Jun. 5, 1995

[51] Int. Cl.[6] ..... B65D 5/42

[52] U.S. Cl. ..... 206/768; 206/232; 206/457; 206/751; 229/116.1

[58] Field of Search ..... 206/457, 232, 206/767, 768, 737, 751, 752, 766; 229/116.1, 116.3, 116.4, 922, 930

[56] References Cited

U.S. PATENT DOCUMENTS

| | | | |
|---|---|---|---|
| 1,681,730 | 8/1928 | Gorton, Jr. | 229/116.4 X |
| 1,682,594 | 8/1928 | Benjamin | 229/116.1 X |
| 1,757,243 | 5/1930 | Goldberg | 229/116.3 X |
| 2,344,437 | 3/1944 | Lande | 206/232 |
| 3,590,500 | 7/1971 | Smith | 206/457 X |
| 4,433,780 | 2/1984 | Ellis . | |
| 4,648,548 | 3/1987 | Shin | 229/116.4 |
| 4,840,275 | 6/1989 | Faiole et al. . | |
| 5,096,058 | 3/1992 | Juravin et al. | 206/232 |
| 5,232,087 | 8/1993 | Schluger . | |
| 5,277,307 | 1/1994 | Kelly . | |

*Primary Examiner*—Bryon P. Gehman
*Attorney, Agent, or Firm*—Joseph W. Holland

[57] ABSTRACT

A combination greeting card/gift box comprising a single sheet blank which has been cut and stamped in such a manner as to present a series of interconnected panels which are connected along stamped fold lines having corner tabs attached along stamped fold lines to the panels, set up tabs attached along stamped fold lines to the panels, and inserts cut into the single sheet blank for receiving the set-up tabs to allow arrangement of the combination greeting card/gift box into one of the several configurations. The combination greeting card/gift is provided with cut-out figures also cut and stamped into the single sheet blank. Additionally, a container is secured to one of the interconnected panels, and in the preferred embodiment contains and displays a memento of some type having contextual relevance to the theme of the card.

8 Claims, 5 Drawing Sheets

COMBINATION GIFT BOX AND GREETING CARD

DESCRIPTION

BACKGROUND OF THE INVENTION

1. Technical Field

This invention relates to a greeting card and more specifically to a greeting card which in a first configuration forms a box which may be gift wrapped, and which in a second configuration may be erected as a stage, having a backdrop with stand-up figurines in the foreground. In addition, the third embodiment may also be provided with a receptacle or other container for holding some item or novelty which relates to the theme of the art.

2. Background

Over the years, greeting cards have taken on numerous configurations. For example, Juravin, U.S. Pat. No. 5,096,058, discloses a combined greeting card and candy holder having a plurality of panels which are foldable relative to one another, and a candy receiving and containing compartment.

Faiola, U.S. Pat. No. 4,840,275, discloses a greeting card and package having a removable, transparent receptacle for a gift or token. The transparent removable receptacle is detachably secured to the card for easy removal from the card.

Schluger, U.S. Pat. No. 5,232,087, discloses a rectangular box bound in the compartment used for containing a gift.

Ellis, U.S. Pat. No. 4,433,780, discloses a greeting card comprising a foldable member formed of cover stock carrying a receptacle for receiving a standard audio cassette.

Kelly, U.S. Pat. No. 5,277,307 discloses a display for a gift and greeting card which comprises a rigid box having an open front for accommodating a gift and/or card.

Each of the above-described inventions caters to a particular need or solves a particular problem presented by the type of greeting which one desires to make for the type of gift or sentiment that one may hope to present.

Often times when individuals vacation, their bags are full when they leave home. Upon reaching their destination, travelers are often concerned with bringing home gifts or other commemorations from their point of destination to their loved ones who remained at home. The problem arises when the traveler realizes that little or no room has been spared within the baggage for transporting gifts of any size home to share with others.

What is needed is a combination greeting card and gift box, which in one configuration would be flat and easy to pack, taking up very little space in the already overcrowded baggage. Upon return home, the combination greeting card/gift box could be erected into another configuration, that being a gift box which may, at the giver's option, be gift wrapped. The gift box may then be presented to the recipient who would unwrap or otherwise open the box and erect it into yet another configuration which presents a colorful backdrop with a greeting, together with pop-up figures and, in some cases, a container or other receptacle which could hold a small memento from the place where the giver has traveled, or some other novelty item.

DISCLOSURE OF INVENTION

Therefore, one object of the present invention is to provide a combination gift box/greeting card which, in one configuration, presents itself as a flat sheet of material which would be relatively easy to pack or otherwise store without damaging the article.

Another object of the present invention would be to provide a combination greeting card/gift box which in an alternative configuration could be presented as a gift box.

Another object of the present invention is to provide a combination greeting card/gift box which in yet another alternative configuration would be arranged to provide a colorful backdrop supported on a base having a greeting thereon.

Another object of the present invention is to provide a combination greeting card/gift box which would be constructed of a single sheet blank having a plurality of panels, tabs, inserts, and fold lines cut or otherwise stamped into the single sheet blank in such a manner as to accommodate the arrangement in any of the three above configurations.

Another object of the present invention is to provide a combination greeting card/gift box which would be manufactured in such a manner as to provide a series of pop-up figurines.

Finally, a last object of the present invention is to provide a combination greeting card/gift box which would provide a means for enclosing a memento or other small gift in a separate receptacle provided with the combination greeting card/gift box.

The objects of the present invention may be accomplished by providing a combined greeting card/gift box comprising a single sheet blank which has been cut and stamped in such a manner as to present a series of interconnected panels which are connected along stamped fold lines, the stamped fold lines serving as hinge means. The combined greeting card/gift box further comprising corner tabs attached along stamped fold lines to the panels, set up tabs attached along stamped fold lines to the panels, and inserts cut into the single sheet blank for receiving the set-up tabs to allow arrangement of the combination greeting card/gift box into one of the several configurations.

BEST MODE FOR CARRYING OUT INVENTION

Figure 1:
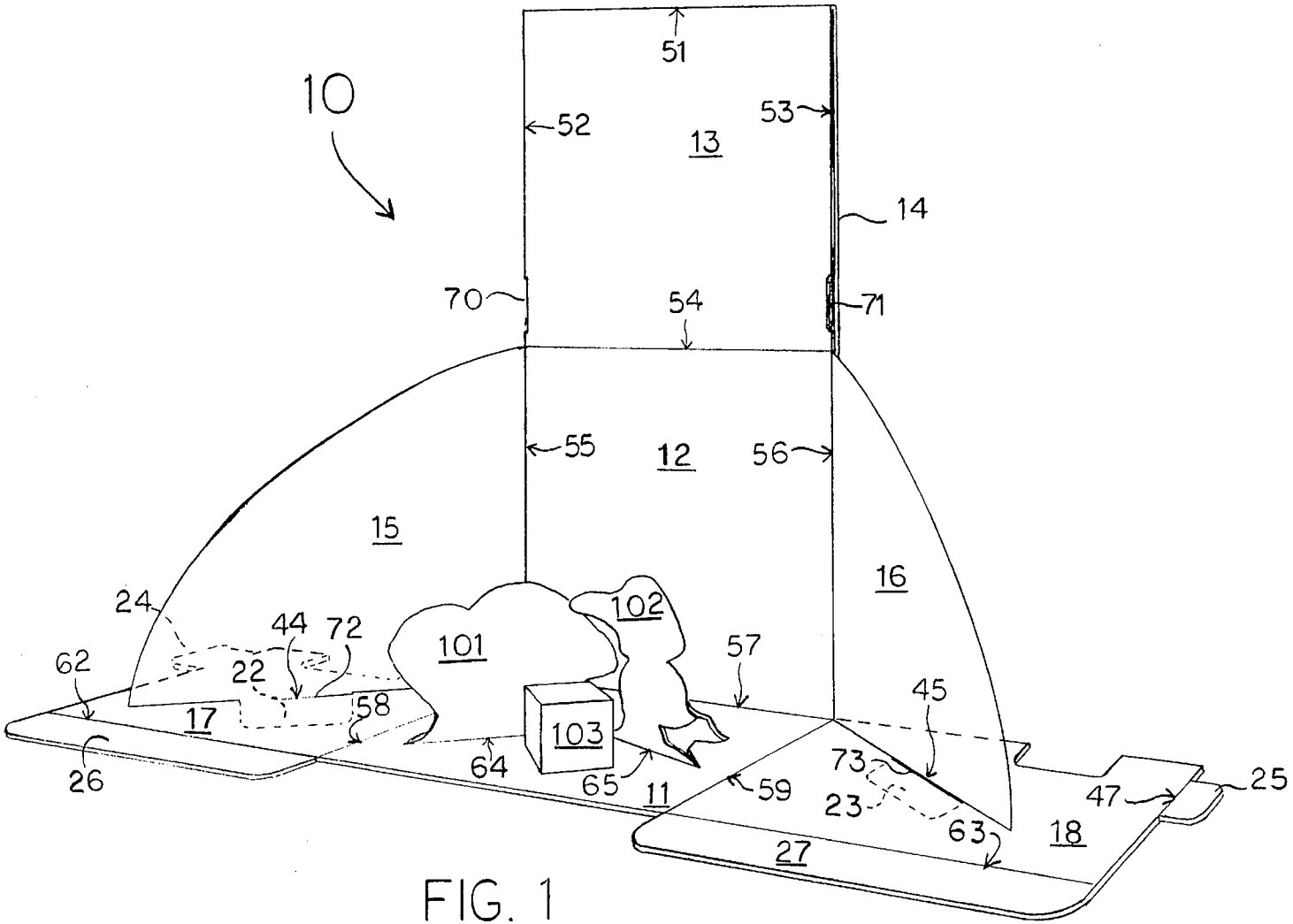
FIG. 1 is a perspective representational view of the combination greeting card/gift box arranged in the greeting card configuration.

Referring now to FIGS. 1 through 6, the preferred embodiment of the combination greeting card/gift box is shown to advantage. Combination greeting card/gift box 10 is formed by stamping and die cutting a single sheet blank to form a plurality of hingedly interconnected panels having tabs and inserts for tabs. FIG. 1 shows the combination greeting card/gift box 10 arranged in the greeting card configuration. Lower back panel 12 forms a backdrop for first cut-out figure 101 and second cut-out figure 102 and container 103. First cut-out figure 101 and second cut-out figure 102 are formed by a die-cutting center base panel 11. Container 103 is secured to center base panel 11 by an adhesive means (not shown).

Figure 3:
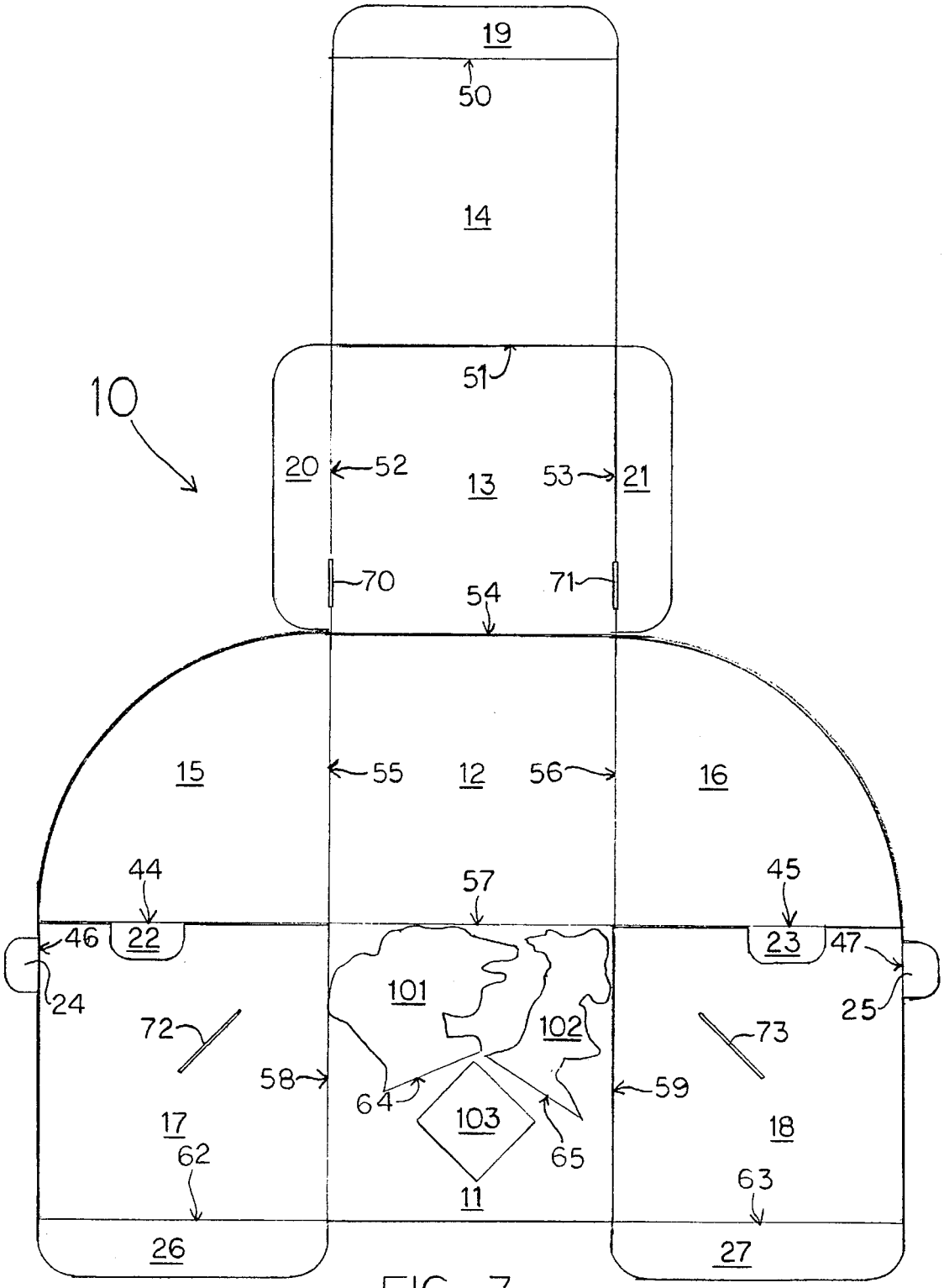
FIG. 3 is a representational top view of the single sheet blank which has been cut and stamped.

Referring now to FIG. 3, lower back panel 11 is connected along lower back panel/center base panel fold line 57 to the bottom edge of lower back panel 12. First side panel 15 is connected by lower back panel/first side panel fold line 55 to lower back panel 12. Similarly, second side panel 16 is connected along lower back panel second side panel fold line 56 to lower back panel 12.

First base panel 17 is connected along center base panel/first base panel fold lines 58 to center base panel 11. Second base panel 18 is connected along center base panel/second base panel fold line 59 to center base panel 11. Upper back panel 13 is connected along upper back panel/lower back panel fold line 54 to the top edge of lower back panel 12. Top panel 14 is connected along top panel/upper back panel fold line 51 to the top edge of upper back panel 13.

Also stamped and die cut into the single sheet blank upon formation is top panel tab 19 which is connected along top panel/top panel tab fold line 50 to the top edge of top panel 14. Similarly, first back corner tab 20 is connected along upper back panel/first back corner tab fold line 52 to a first side of upper back panel 13. Second back corner tab 21 is connected along upper back panel/second back corner tab fold line 53 to a second side edge of upper back panel 13. First side set-up tab 22 is connected along first side panel/first side set-up tab fold line 44 to the bottom edge of first side panel 15. Similarly, second side set-up tab 23 is attached along second side set-up tab/second side panel fold line 45 to the bottom edge of second side panel 16.

First side closure tab 24 is connected along first side closure tab/first base panel fold line 46 to the first side edge of first base panel 17. Similarly, second side closure tab 25 is joined along second side closure tab/second base panel fold line 47 to a second side of second base panel 18. First top corner tab 26 is connected along first top corner tab/first base panel fold line 62 to the bottom edge of first base panel 17. Likewise, second top corner tab 27 is connected along second top corner tab/second base panel fold line 63 to the bottom edge of second base panel 18.

Also formed by stamping and cutting into the single sheet blank are first side closure insert 70 which is cut along first back corner tab/upper back panel fold line 52, second side closure insert 71, which is cut along second back corner tab/upper back panel fold line 53. The first side set-up insert 72 is stamped into first base panel 17. Similarly, second side set-up insert is cut into second base panel 18.

In the preferred embodiment, first cut-out figure 101 which is cut into center base panel 11 is connected to center base panel 11 along first cut-out figure fold line 64. Similarly, second cut-out figure 102 is connected to center base panel 11 along second cut-out figure fold line 65. While there is shown here an embodiment wherein first cut-out FIG. 101 and second cut-out figure 102 are connected to center base panel 11, other embodiments are anticipated wherein cut-out figures may be formed by cutting and stamping such figures in any of the panels including upper back panel. 13, lower back panel 12, first side panel 15, second side panel 16, first base panel 17 and second base panel 18.

Referring now to FIG. 3, combination greeting card/gift box 10 is formed in a single operation by stamping and die cutting a single sheet blank to form the necessary cuts and fold lines. Combination greeting card/gift box 10 may be readily stored and displayed in this flat configuration as shown in FIG. 3.

Referring now to FIGS. 3, 4, 5 and 6, it can be seen how combination greeting card/gift box 10 may be arranged in a gift box configuration. Greeting card/gift box 10 is folded initially along lower back panel/center base panel fold line 57, so that lower back panel 12 is perpendicular to center base panel 11. Similarly, first side panel 15 is perpendicular to first base panel 17 and second side panel 16 is perpendicular to second base panel 18 as shown to advantage in FIG. 4. First side set up tab 22 is folded along first side panel/first side set up tab fold line 44 to accommodate the placement of first side panel 15 in this configuration. Similarly, second side set up tab 23 is folded along second side set up tab/second side panel fold line 45 to accommodate the placement of second side panel 16 in this configuration.

Next, first side panel 15 is bent along center base panel/first base panel fold line 58 so that first side panel 15 is now also perpendicular to lower back panel 12. Similarly, second side panel 16 is folded along center base panel/second base panel fold line 59, so that second side panel 16 is perpendicular to lower back panel 12.

Next, first back corner tab 20 is folded along upper back panel/first back corner tab fold line 52 to allow folding and insertion of first back corner tab 20 inside the radiused top edge of first side panel 15. Similarly, second back corner tab 21 is folded along upper back panel/second back corner tab fold line 53 to allow folding and insertion of second back corner tab 21 within the radiused top edge of second side panel 16. Upper back panel 13 is then folded along upper back panel/lower back panel fold line 54 so that upper back panel 13 lies in a plane perpendicular to the plane of center base panel 11, with first back corner tab 20 inserted within the radiused top edge of first side panel 15 and second back corner tab 21 inserted within the radiused top edge of second side panel 16.

First side closure tab 24 is folded along first side closure tab/first base panel fold line 46, positioning first side closure tab 24 for insertion into first base panel side tab insert 70. Similarly, second side closure tab 25 is folded along second side closure tab/second base panel fold line 47, positioning second side closure tab 25 for insertion into second base panel side tab insert 71.

Next, first base panel 17 is folded along center base panel/first base panel fold line 58, allowing first side closure tab 24 to be inserted into first base panel side tab insert 70. Similarly, second base panel 18 is folded along center base panel/second base panel fold line 59, allowing second side closure tab 25 to be inserted into second base panel side tab insert 71.

Figure 6:
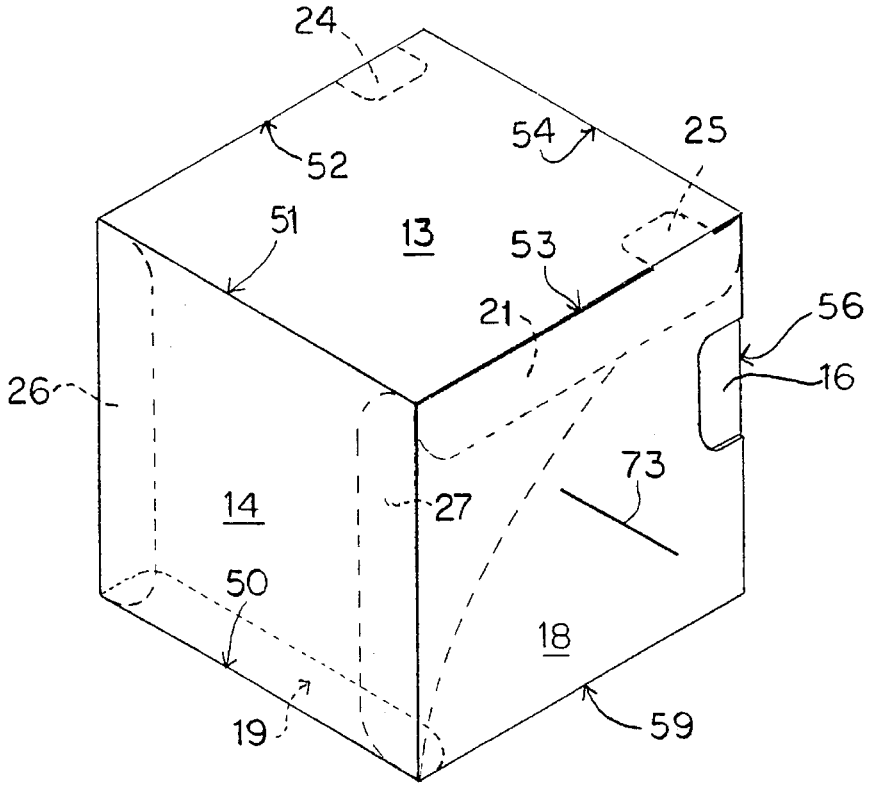
FIG. 6 is a front perspective representational view of the combination greeting card/gift box in the gift box configuration.

Next, first corner tab 26 is folded along first top corner tab/first base panel fold line 62 forming side a closures for what will ultimately be the top of greeting card/gift box 10 in the gift box configuration. Similarly, second top corner tab 27 is folded along second top corner tab/second base panel fold line 63 to form a second side closure for the top of greeting card/gift box 10 in the gift box configuration. Top panel 14 is folded along top panel/upper back panel fold line 51, closing the top end of the gift box. Top panel tab 19 is inserted into the edge of the box formed by the bottom side of center base panel 11, as seen in FIG. 6. In this configuration, the combination greeting card/gift box 10 may be wrapped or simply presented as a gift box.

Figure 2:
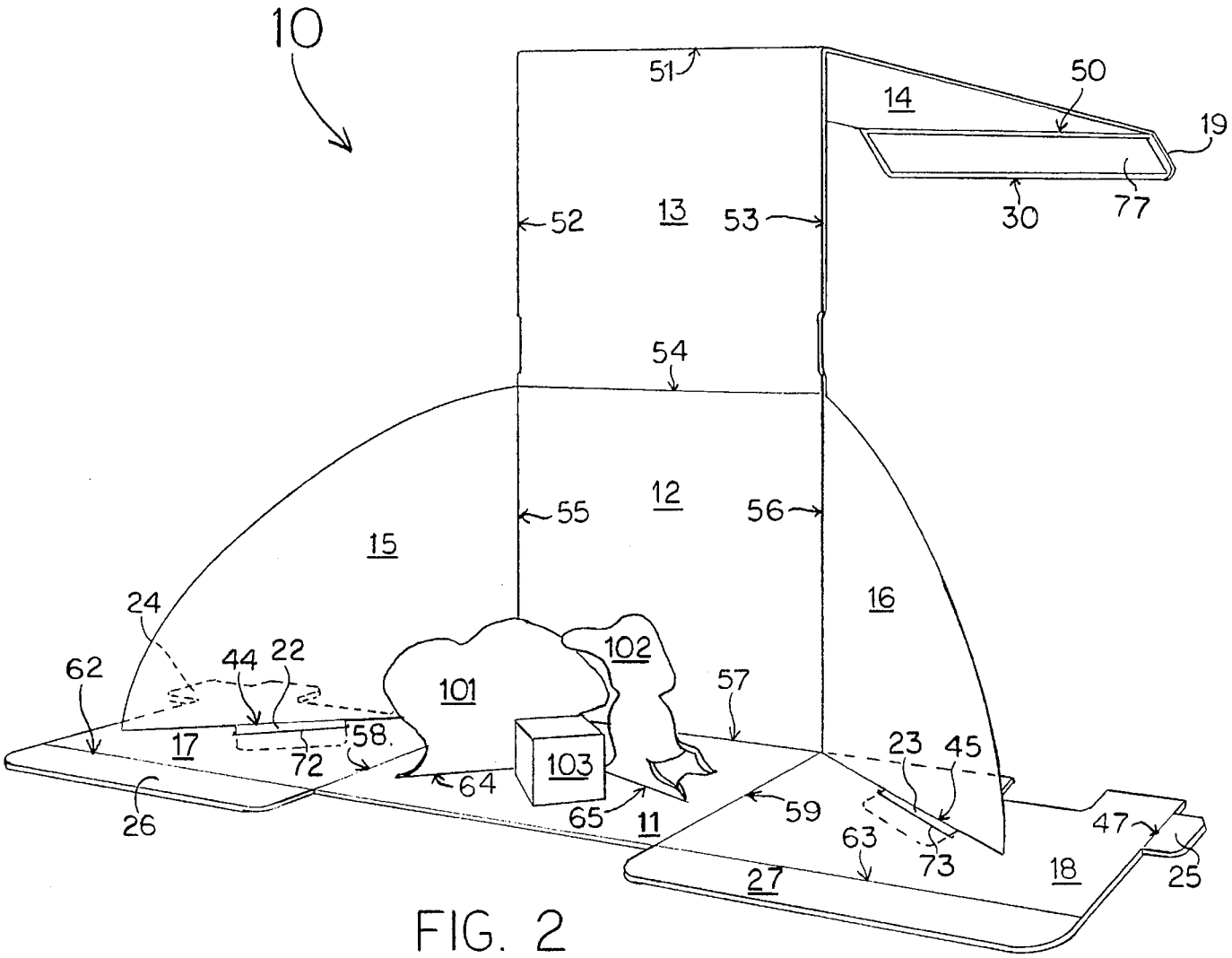
FIG. 2 is a perspective representational view of the combination greeting card/gift box.
Figure 4:
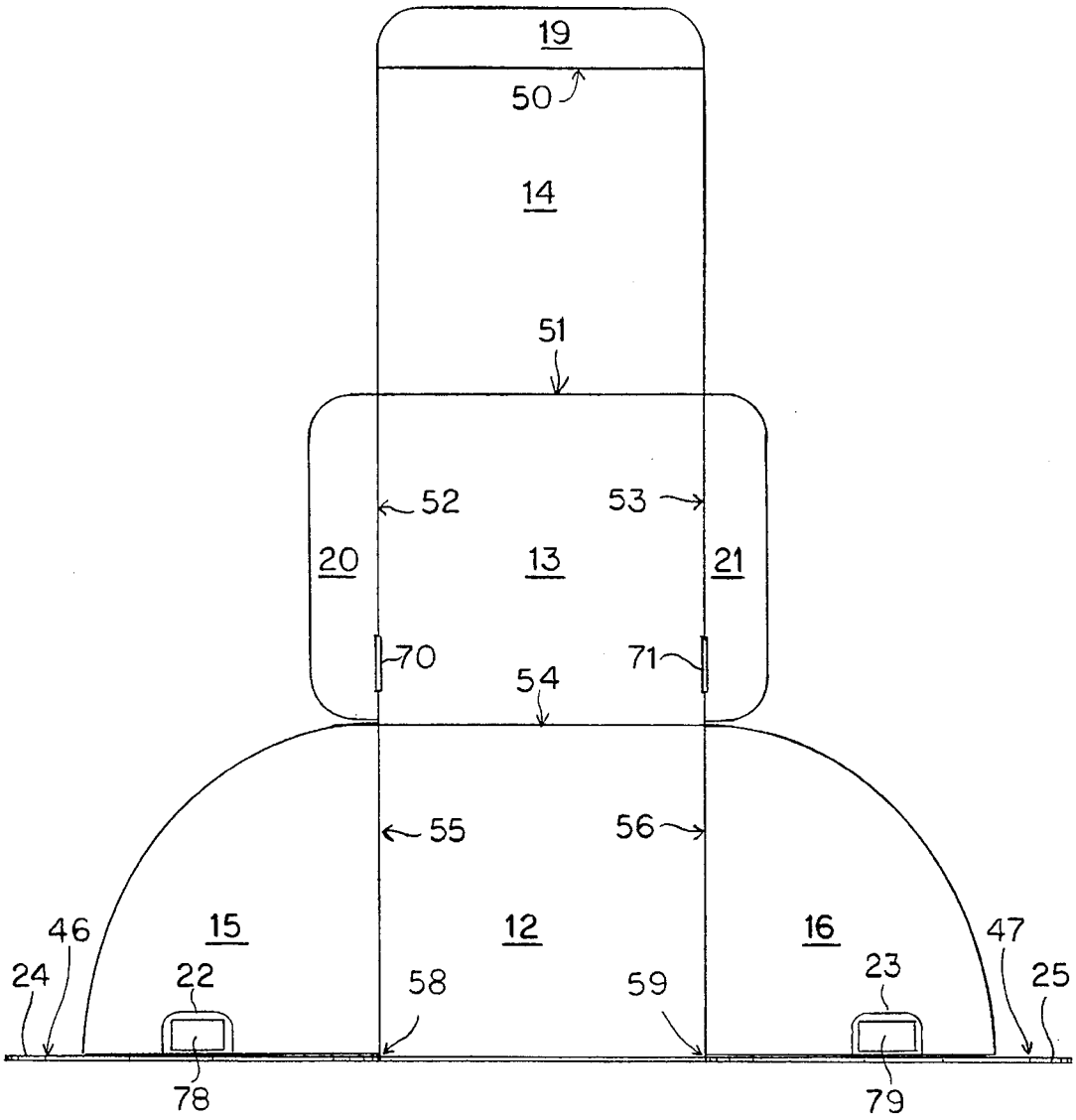
FIG. 4 is a representational front view of the combination greeting card/gift box.
Figure 5:
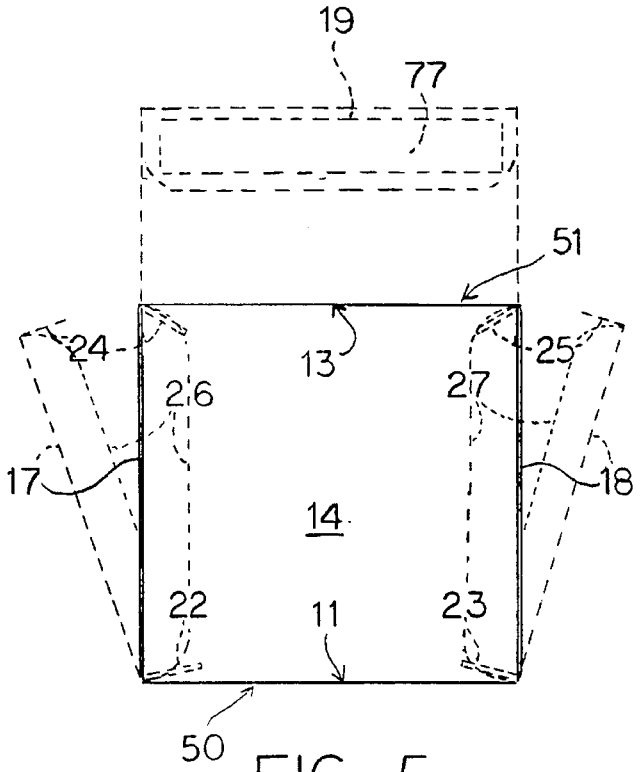
FIG. 5 is a representational front view of the combination greeting card/gift box.

Referring to FIGS. 1, 2 and 3, it may readily be seen how greeting card/gift box 10 may be configured for the greeting card configuration. Once again, lower back panel 12 is folded along lower back panel/center base panel fold line 57 so that lower back panel 12 forms a back drop for what will be the base of the greeting card/gift box 10 in its greeting card configuration. Center base panel 11 will form the base of greeting card/gift box 10 in its greeting card configuration. First side panel 15 is folded forward along lower back panel, first side panel fold line 55. First side set up tab 22 is folded along first side panel/first side set up tab fold line 44 to accommodate insertion of first side set up tab 22 into first side panel tab insert 72. Similarly, second side panel 16 is folded along lower back panel/second side panel fold line 56. Second side set up tab 23 is folded along second side set up tab/second side panel fold line 45, allowing insertion of second side set up tab 23 into second side panel tab insert 73. Referring to FIG. 4, there can be seen on the back side of first side set up panel 22, an adhesive tab consisting of transfer tape, which, when greeting card/gift box 10 is set up in the greeting card configuration, adhesive tab 78 contacts the backside or underside surface of first base panel 17, facilitating the erection of greeting card/gift box 10. Similarly, adhesive tab 79 is located on second side set up tab 23 which functions in the same manner contacting the backside or underside surface of second base panel 18.

Next, first back corner tab 20 is folded backwards along upper back panel/first back corner tab fold line 52 so that first back corner tab 20 lies flat against the back side of upper back panel 13. Similarly, second back corner tab 21 is folded backward along upper back panel/second back corner tab fold line 53 so that it lies flat against upper back panel 13.

Next, top panel 14 is folded backwards along top panel/upper back panel fold line 51 so that top panel 14 lies flat against the back of upper back panel 13 holding and securing in place first back corner tab 20 and second back corner tab 21. Adhesive tab 77, located on the backside of top panel tab 19 adheres to the back side of lower back panel 12 securing top panel 14 and first and second back corner tabs 20 and 21 in position for the display of greeting card/gift box 10 when arranged in the greeting card configuration.

First cut out figure 101 is folded along first cut out figure fold line 64 and second cut out figure 102 is folded along second cut out figure fold line 65, both to the upright position for display. As can be seen in FIG. 1, container 103 is secured to center base panel 11 and in the preferred embodiment contains and displays a memento of some type having contextual relevance to the theme of the card.

While there is shown and described the present preferred embodiment of the invention, it is to be distinctly understood that this invention is not limited thereto but may be variously embodied to practice within the scope of the following claims.

I claim:

1. A combined greeting card and gift box formed by preselectively stamping and cutting a single sheet blank to form a plurality of interconnected panels having tabs and tab inserts, the interconnected panels being arranged so that each panel is hingedly connected to at least one other panel along a fold line wherein the combined greeting card and gift box may be arranged in one of a first gift box configuration and a second greeting card configuration by folding the interconnected panels along the fold lines interconnecting the panels and inserting the tabs into corresponding tab inserts, wherein the first gift box configuration comprises:

a lower back panel;

a center base panel perpendicular to the lower back panel;

a first side panel perpendicular to the lower back panel;

a second side panel perpendicular to the lower back panel and parallel with the first side panel;

an upper back panel perpendicular to the lower back panel and parallel with the center base panel;

a first base panel perpendicular to the center base panel;

a second base panel perpendicular to the center base panel and parallel with the first base panel; and a top panel perpendicular to the upper back panel and parallel with the lower back panel; and wherein the second greeting card configuration comprises:

the center base panel perpendicular to the lower back panel;

the upper back panel extending from the lower back panel and coplanar with the lower back panel;

the first base panel extending from the center base panel and coplanar with the center base panel;

the second base panel extending from the center base panel and coplanar with the center base panel;

the first side panel perpendicular to and engaging via a tab and tab insert, the first base panel, for supporting the lower back panel in a vertical plane;

the second side panel perpendicular to and engaging via a tab and tab insert, the second base panel, for supporting the lower back panel in a vertical plane; and the top panel folded backwards so that the top panel lies flat against the back of the upper back panel.

2. The combined greeting card and gift box of claim 1 further comprising a cut-out figure stamped, cut into and hingedly connected to at least one of the plurality of interconnected panels.

3. The combined greeting card and gift box of claim 1 further comprising a container attached to at least one of the plurality of interconnected panels.

4. The combined greeting card and gift box of claim 1 wherein the first gift box configuration further comprises a top panel tab connected along a top panel/top panel tab fold line to the top panel and is inserted into the edge of the box formed by the bottom side of the center base panel.

5. A combined greeting card and gift box formed by preselectively stamping and cutting a single sheet blank to form a plurality of interconnected panels having tabs and tab inserts, the interconnected panels being arranged so that each panel is hingedly connected to at least one other panel along a fold line wherein the combined greeting card and gift box may be arranged in one of a first gift box configuration and a second greeting card configuration by folding the interconnected panels along the fold lines interconnecting the panels and inserting the tabs into corresponding tab inserts, wherein the first gift box configuration comprises:

a center base panel;

a lower back panel folded along a lower back panel/center base panel fold line so that the lower back panel is perpendicular to the center base panel;

a first side panel folded along a lower back panel/first side panel fold line so that the first side panel is perpendicular to the lower back panel;

a second side panel folded along a lower back panel/second side panel fold line so that the second side panel is perpendicular to the lower back panel and parallel with the first side panel;

an upper back panel folded along a upper back panel/lower back panel fold line so that the upper back panel is perpendicular to the lower back panel and parallel with the center base panel;

a first base panel folded along a center base panel/first base panel fold line so that the first base panel is perpendicular to the center base panel;

a second base panel folded along a center base panel/second base panel fold line so that the second base panel is perpendicular to the center base panel and parallel with the first base panel;

a top panel folded along a top panel/upper back panel fold line so that the top panel is perpendicular to the upper back panel and parallel with the lower back panel; and wherein the second greeting card configuration comprises:

the lower back panel folded along the lower back panel/center base panel fold line so that the lower back panel is perpendicular to the center base panel;

the upper back panel extending from the lower back panel and coplanar with the lower back panel;

the first base panel extending from the center base panel and coplanar with the center base panel;

the second base panel extending from the center base panel and coplanar with the center base panel;

the first side panel folded along the lower back panel/first side panel fold line so that the first side panel is perpendicular to the first base panel and supporting the lower back panel in a vertical plane;

a first side set-up tab attached along a first side set-up tab/first side panel fold line to the bottom edge of the first side panel, the first side set-up tab being inserted into and engaging a first side panel tab insert, supporting the lower back panel in a vertical plane;

the second side panel folded along the lower back panel/second side panel fold line so that the second side panel is perpendicular to the second base panel, supporting the lower back panel in a vertical plane;

a second side set-up tab attached along a second side set-up tab/second side panel fold line to the bottom edge of the second side panel, the second side set-up tab being inserted into and engaging a second side panel tab insert, supporting the lower back panel in a vertical plane; and the top panel folded backwards along a top panel/upper back panel fold line so that the top panel lies flat against the back of the upper back panel.

6. The combined greeting card and gift box of claim 5 further comprising a container attached to one of the panels selected from the group of panels consisting of the center base panel, the first side base panel and the second side base panel.

7. The combined greeting card and gift box of claim 5 further comprising a cut-out figure stamped, cut into and hingedly connected to at least one of the plurality of interconnected panels.

8. The combined greeting card and gift box of claim 5 wherein the first gift box configuration further comprises a top panel tab connected along a top panel/top panel tab fold line to the top panel and is inserted into the edge of the box formed by the bottom side of the center base panel.

* * * * *